United States Patent [19]

Nielsen et al.

[11] 4,309,885

[45] Jan. 12, 1982

[54] MACHINE FOR FORMING A HEAD ON A SHANK, SUCH AS A NAIL OR A SCREW

[75] Inventors: Ove Nielsen, Hørsholm; Leif Nielsen, Ballerup; Tarras Wanheim, Copenhagen, all of Denmark

[73] Assignee: Aktieselskabet Nordiske Kabel- og Traadfabriker, Copenhagen, Denmark

[21] Appl. No.: 202,089

[22] Filed: Oct. 30, 1980

Related U.S. Application Data

[63] Continuation of Ser. No. 13,114, Feb. 21, 1979, abandoned.

[30] Foreign Application Priority Data

Feb. 23, 1978 [DK] Denmark ..... 819/78

[51] Int. Cl.[3] ..... B21G 3/12; B21G 3/28; B21G 3/30; B21G 3/32

[52] U.S. Cl. ..... 72/197; 10/6; 10/39; 10/52; 72/423

[58] Field of Search ..... 10/2, 6, 35, 39, 40, 10/43, 48, 52, 53, 60–62, 69, 70; 72/91, 112, 124, 133, 190, 191, 197, 423

[56] References Cited

U.S. PATENT DOCUMENTS

| | | | |
|---|---|---|---|
| 358,553 | 3/1887 | Hill | 10/47 |
| 364,119 | 5/1887 | Lewis | 10/52 |
| 2,621,343 | 12/1952 | Fray | 10/6 |
| 2,642,594 | 6/1953 | Fray | 10/6 |
| 2,917,756 | 12/1959 | Stearns et al. | 10/52 |
| 2,929,301 | 3/1960 | Stalhuth | 10/6 |
| 3,111,697 | 11/1963 | Wilson | 10/6 |
| 3,165,765 | 1/1965 | Wilson | 10/6 |
| 3,585,665 | 6/1971 | Jackson | 10/6 |

*Primary Examiner*—Ervin M. Combs
*Attorney, Agent, or Firm*—Ladas & Parry

[57] ABSTRACT

A machine for forming heads on shanks, in particular nail heads, where the shanks are temporarily secured in a preferably rotary tool defining wholly or partially the shape of the heads and co-operating with a rotary roll. According to the invention at least one roll is adapted for internal rolling with respect to one or more of rings serving as tools, the shanks being located substantially radially in said rings.

14 Claims, 12 Drawing Figures

MACHINE FOR FORMING A HEAD ON A SHANK, SUCH AS A NAIL OR A SCREW

Figure 1:
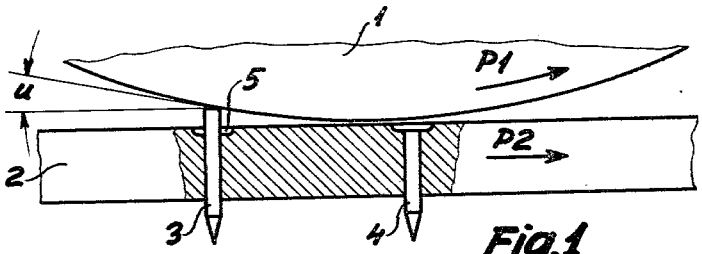

This is a continuation of co-pending application Ser. No. 013,114 filed Feb. 21, 1979 and now abandoned.

The invention relates to a machine for forming a head on a shank, in particular for forming heads on nails or screws in a single process of working by combined forging and rolling, said machine comprising at least one driven roll for acting on one end of a shank secured in an annular, preferably rotating tool, the shank being driven at a speed different from that of the surface of the roll.

The U.S. Pat. No. 2,917,756 discloses an apparatus for forming nail heads, where the nail shank is placed axially in an annular tool and extends beyond one, plane side face thereof, said face being provided with a mould cavity defining the shape of the nail head. The nail head is formed in that rotation of said tool about its axis causes the nail shank to co-operate with a plurality of rolls mounted for rotation about respective axes, each of which being perpendicular to the axis of the tool, at a peripheral speed somewhat greater than the nail shank peripheral speed about the axis of the tool. In this known machine the nail head is formed in a manner, whose principles are known, it being formed by several successive strokes by means of a plurality of rolls.

Said known machine has its drawbacks, however. Firstly, it is necessary to mount idler rolls, serving as backstop means, in a number corresponding to that of the rolls mentioned above, on the opposite side of the plane side face of the tool. As mentioned, the peripheral speed of the heading rolls exceeds the speed of the nail shank to prevent the protruding end of the shank from being bent rearwardly with respect to the tool rotating direction when the shank end hits a roll. Thus, in order for a roll to urge forwardly the shank end there must be a sufficiently large frictional force between the roll and the shank end. The frictional force obtained will be sufficient only if rolls with a relatively large diameter are employed, which makes the known machine large and expensive to manufacture. Moreover, the finished nails are ejected from the known machine by means which are not simple and reliable.

The object of the invention is to provide a machine of the subject type, which obviates said drawbacks.

This object is achieved in that the annular tool is adapted to secure a plurality of shanks so that they are located substantially radially in said tool, and in that the roll is mounted for acting on the end of the shanks which faces towards the centre of the tool.

The invention is based on the new recognition that the angle between the tangents for the tool and the roll respectively at the point where the shank contacts the roll, should be as acute as possible, and in practice it may be as acute as 3° when forming a conventional nail head. To achieve this by the prior art using external rolling, the number of the rolls and/or their diameters must be larger than is feasible in practice at reasonable costs. However, since the invention is based on internal rolling, it permits arbitrarily small angles between said tangents at roll diameters which are easily realized. Internal rolling involves another advantage since the production rate may be increased because several shanks may be placed side by side in axial planes of the annular tool, allowing the heads to be formed by a single roll. Such increase in production rate cannot be achieved by the prior art because the nail shank speed depends upon the respective distances of the shanks from the axis of rotation of the annular tool. Further, the prior art can only be used for making nails of a specific length, whereas the machine according to the invention is capable of making nails whose length is not limited by the tools as the nail points may protrude freely beyond the outer periphery of the tool.

To obtain the best possible spreading of material in the mould cavity, the peripheral speed of the roll is advantageously somewhat greater than the speed of the shanks. This permits the achievement of a completely symmetrical head seen from the end face, but in some cases said head is not exactly perpendicular to the shank. A symmetrical head perpendicular to the shank may be obtained by making each shank form an acute angle with a line through the centre of the tool and through the end of the shank facing the centre, such that the shank is located in front of said line with respect to its direction of rotation.

A preferred embodiment of the annular tool is characterized in that the tool comprises two or more rings of a uniform construction and positioned side by side, said rings having a plurality of mould halves adapted in pairs to receive a shank, and in that means are provided for retaining the shanks against longitudinal movement when the respective mould cavities are located within a working area where the roll co-operates with the shanks. The annular tool is preferably provided with mould jaws preferably replaceably mounted in the ring side faces directed towards each other. As a result of this the machine may easily be adapted for forming heads of other dimensions.

The means for securing the shanks comprise a stop means for co-operating with the shanks at the working area, said stop means being mounted closely adjacent the outer periphery of the rings.

The shanks may also be secured in that at least a portion of each mould jaw extends substantially axially with respect to the rotation axes of the rings out through an associated recess in the associated ring a distance beyond its outwardly facing side face for co-operating with stop means at the working area, said stop means being mounted on opposite sides of the rings.

The rings are mounted for rotation such that their respective ring planes which are disposed perpendicularly to the associated ring rotation axes, diverge seen from the working area. This means that the shanks may be secured in a very simple manner in the working area, and that the blanks may very easily be inserted and removed over a large part of the periphery outside the working area.

The roll is normally mounted such that its axis of rotation defines the mean direction of the rotation axes of the rings.

Said difference in speed between roll and shank can be achieved in a very simple manner for example by providing each ring with a roll path facing the associated axis of rotation and adapted to abut on a corresponding roll path on the roll, the diameter of the roll path on the roll being smaller than the diameter of the roll surface which co-operates with the shanks, said roll surface clearing said mould jaws. This also makes it possible to bias the roll by pressing it against the internal periphery of the tool, the roll being supported by said roll paths such that the roll surface just clears the mould jaws. Furthermore, it is possible to drive either the roll or the tool alone, the driving power being transferred via the roll paths. If sufficient driving power cannot be transferred in this manner, the rolls paths may be toothed.

The mould jaws are much simpler to manufacture, for example with a conical opening, when each mould cavity includes a channel-shaped cavity serving to receive a portion of the shank and merging into an evenly increasing opening at the end facing the centre of the annular tool. The parameters of the machine, such as the relative difference in speed between the roll and the tool, the angle of entry between the shank and roll as well as other parameters, may be adapted so as to obtain a head where only its under side is defined by the mould cavity, while its rim is produced by a free spreading of the material. It is also possible to produce a head with a D-shaped end face by free forming, for example by providing one mould jaw with a face directed towards the other mould jaw, the plane of said face touching the channel wall in the first-mentioned mould jaw and extending inwardly and towards the centre of the annular tool for abutting on one of the side faces plane of the roll. Hereby it is achieved that the straight edge of the head is exactly flush with the nail shank, which is important if the nails are to be stacked for being inserted into the magazine of a nail gun where the nails must be positioned closely adjacent each other. The same may be obtained by providing the roll with an annular flange extending from the roll surface so as to define a radial face whose plane touches the channel wall in one mould jaw which is recessed so as to clear the outer circumference of the flange. Other advantageous effects of this are that no burrs can be formed along the straight edge of the head, and that the diameter of the flange need not be large because the deformation of the end of the nail shank do not spread far down into the shank.

As mentioned above the free forming entails that the upper side of the head is located outside the mould jaws, permitting such a large roll clearance with respect to the mould jaws that small foreign bodies cannot get jammed between the roll and the mould jaws. The roll paths mentioned above may be omitted by securing a gear wheel, at one or either side of the roll, to the shaft for co-operating with an internal toothing in a respective one of the said rings, the pitch diameter of the gear wheels being smaller than the diameter of the roll surface directed towards the shanks. This makes the working area of the machine insensitive to small foreign bodies.

The power transmission of the machine may be completely confined in one side, while the other side is free and permits ejection of the finished blanks and inspection of the working area without any risk of foreign bodies getting jammed, by providing a single gear wheel for co-operating with an internal toothing in one of the rings, said toothing being in engagement with a toothed drive driven by a drive motor, there being provided a guardplate between the roll and said ring, which plate is located substantially closely adjacent the internal periphery of the ring.

Further control facility may be obtained by providing a friction-increasing pattern on the surface of the roll, which co-operates with the shanks.

By providing the periphery of the roll co-operating with the shanks, with an annular bead, it is possible to make both a screw head and a slot therein in one and the same operation, the dimensions of said slot being defined by the bead.

Figure 2:
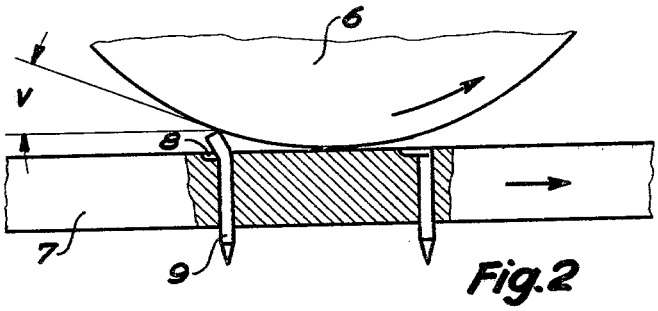
Figure 3:
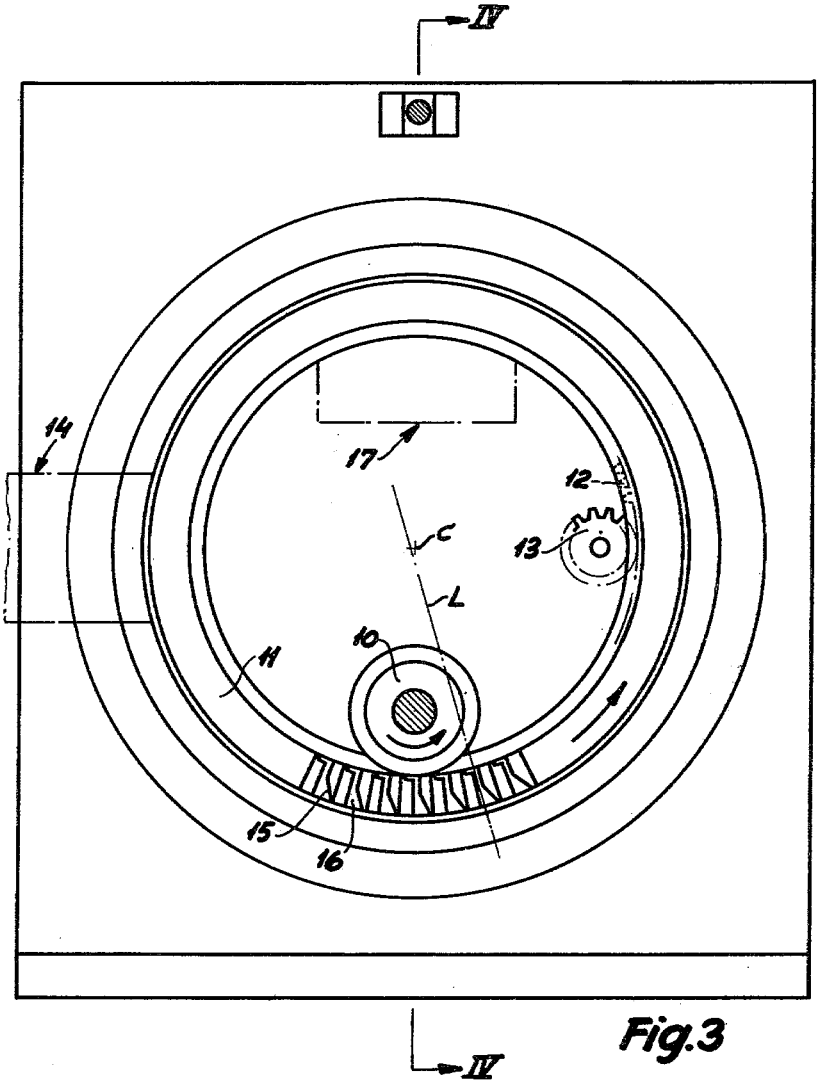
Figure 4:
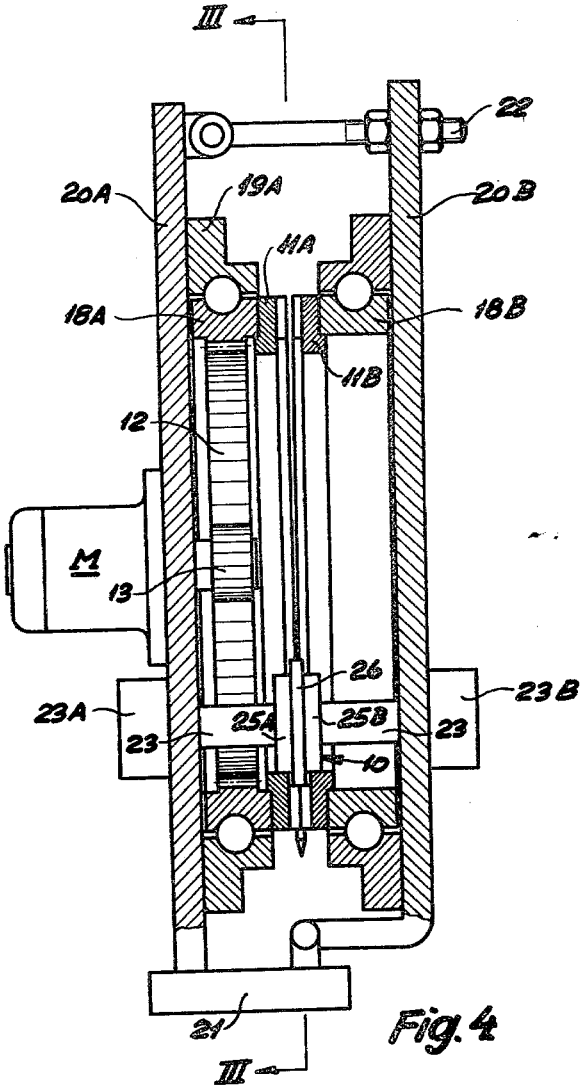
Figure 5:
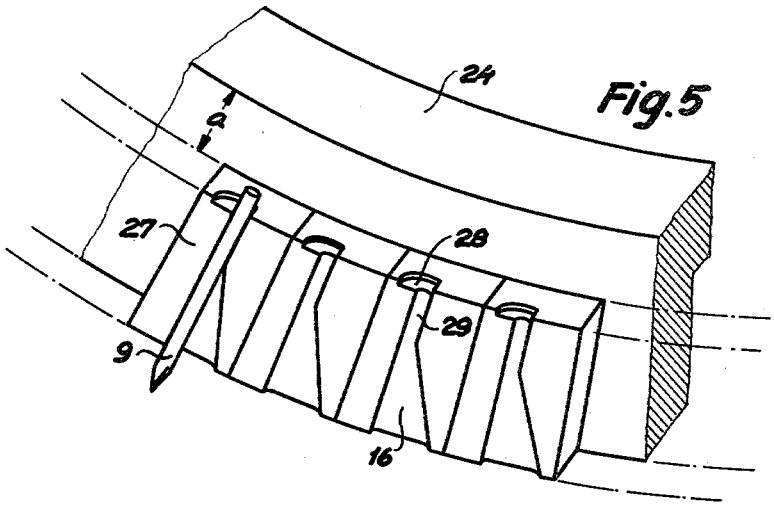
Figure 6:
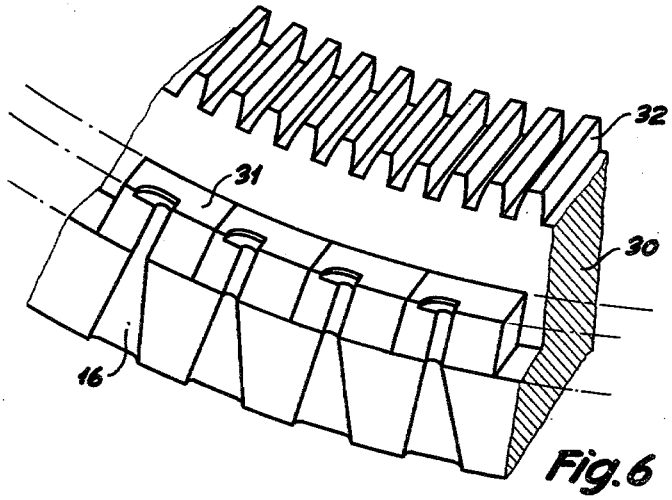
Figure 7:
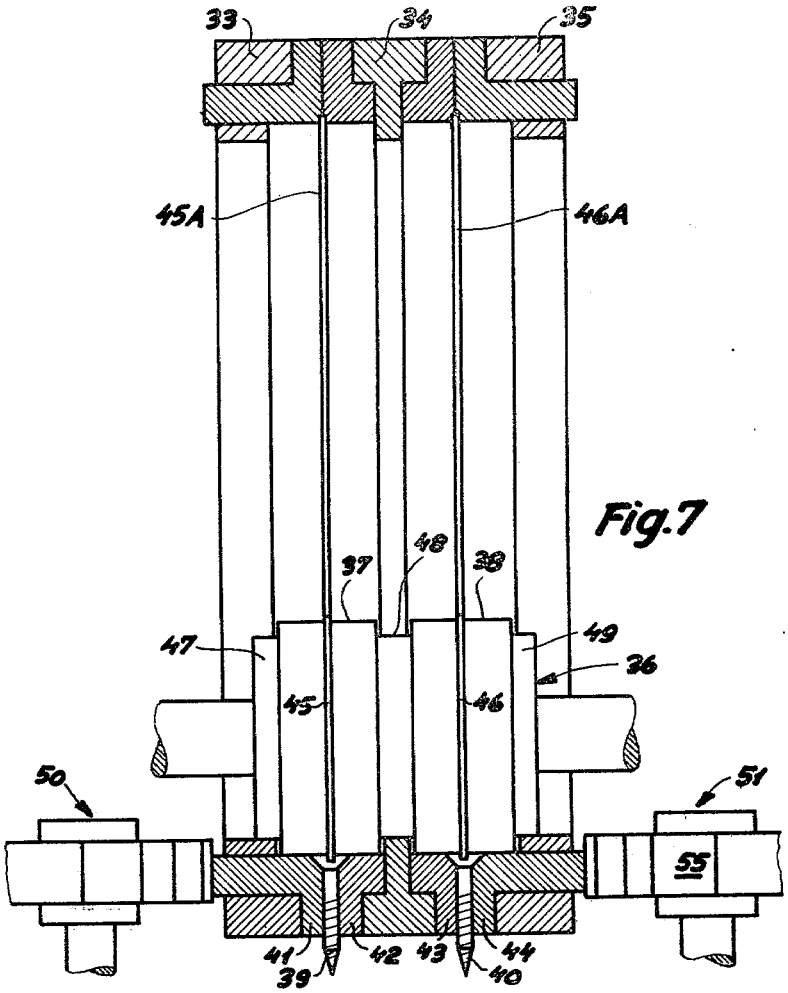
Figure 8:
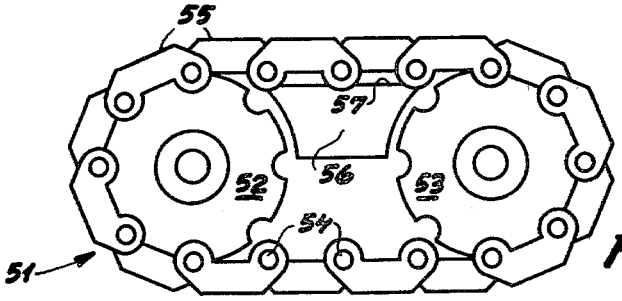
Figure 9:
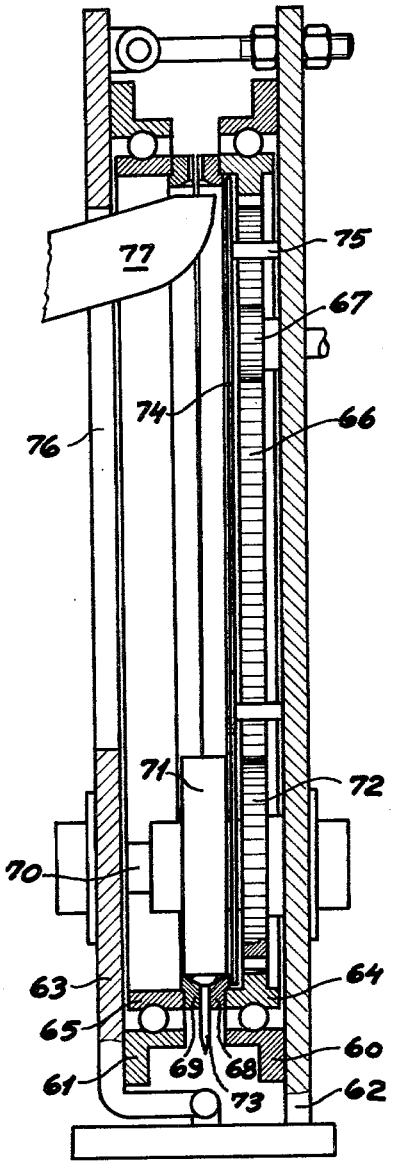
Figure 10:
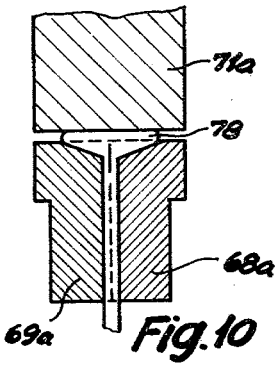
Figure 11:
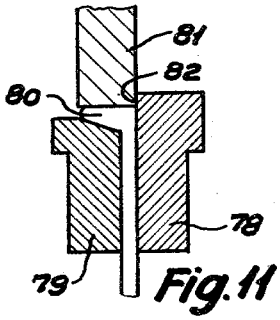
Figure 12:
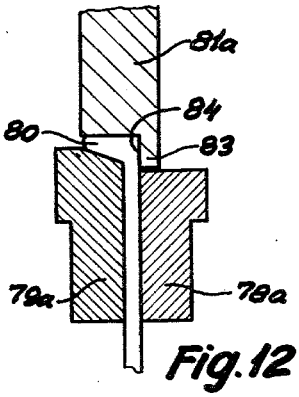

The invention will be explained in more detail in the following description of some embodiments with reference to the drawing, in which FIG. 1 is a sketch of the principle on which the invention is based, FIG. 2 the same as FIG. 1, but related to the making of a reduced head (D-shaped), FIGS. 3 and 4 show a first embodiment of the machine according to the invention, where FIG. 3 shows a vertical section taken along the line III—III in FIG. 4, while FIG. 4 shows a section as indicated by VI—VI in FIG. 3, FIGS. 5 and 6 show a section of two embodiments of the annular tool, FIG. 7 shows a section of another embodiment of the machine according to the invention, FIG. 8 shows a clamping means for clamping the blanks to be provided with a head, FIG. 9 shows still another embodiment of the machine according to the invention, and FIGS. 10–12 show various embodiments of mould jaws for the machine.

The new recognition on which the invention is based, will be explained with reference to FIGS. 1 and 2 before the description of some embodiments of the machine according to the invention. The following description concerns the making of nails though the machine may also be used for forming heads on for example screws or bolts, as mentioned above. It has been found that a well-defined spreading of the nail material is obtained when the impact on the material is a combination of forging, which is well-known for making nails, and rolling. To obtain a complete filling of the mould cavity there may advantageously be provided a relative difference in speed between the roll and the tool securing the nail. FIG. 1 shows a roll 1 which revolves in the direction of the arrow P1 and is adapted to co-operate with nail blanks 3,4 secured in a tool 2 moved translatorily in the direction of the arrow P2. Thus, the peripheral speed of the roll 1 is somewhat greater than the translatory speed of the tool 2.

Moreover, it has been found that the relatively acute angle of entry of the nail blank is important for an efficient and well-defined spreading of the nail material in the mould cavity 5 which wholly or partially defines the shape of the nail head. The angle of entry is defined as the angle U in FIG. 1 and is equal to the angle between the tangent to the roll 1 at the point where it initially hits the nail blank 3 and the tangent to the tool 2 at the point where the nails 3 are secured in the tool. In the example shown the tangent to the tool 2 is parallel with the tool itself, but the definition of the angle U in dependency of the tangent to the tool is advantageous where the tool is curved. In some cases the angle of entry must be so acute that it is impossible in practice in the manner shown in FIG. 1, it being necessary for the roll 1 to have a very large diameter. According to the invention the tool consists of one or more rings in which the roll 1 revolves, permitting very small values for the angle U.

The embodiment of the invention which will be described first, is adapted to make for example nails with a reduced head. Such nails are mainly used for nail guns where the nails must be stacked before they are inserted into the nail gun. The stacking consists in placing the nails in one plane closely adjacent each other, and they can therefore be brought closer to one another if the head is reduced so that the nail shanks may abut on one another over the entire length of the nail. When the nail head is viewed from above, this is tantamount to there being removed a segment of a circle from said head. FIG. 2 shows analogously with FIG. 1 a roll 6 and a tool 7 with a mould cavity 8 for a reduced head. When nails with a reduced head are to be made, the angle of entry U must be made somewhat larger than is required in respect of nails with a full head, but the increased angle of entry is still not feasible by means of the prior art. When the nail blank hits the roll 6 under the increased angle of entry, the nail blank 9 will be bent rearwardly as shown in FIG. 2 and downwardly towards the mould cavity 8. Later on the tangent angle V becomes so acute that friction between the roll 6 and the nail blank 9 results in an initial rolling, and the combined process of rolling and forging produces a nail without burrs and with well-defined tolerances so that the finished nail may be stacked direct without any intermediate working. Up to now it has been necessary to subject the nails to a finishing treatment of about 20 minutes to deburr them, and the known tools have till now required continuous and careful maintenance in order for the tolerances of nails for nail guns to be observed. In the machine according to the invention the tools are not worn noticeably, firstly because the material is subjected to an even impact which is not in the nature of a stroke, and secondly because the rearward bending of the nail blank relieves the nail shank of axial pressure, obviating burrs from tools for retaining the nail shank against a large axial force.

FIG. 3 shows a vertical longitudinal section of an embodiment of the machine according to the invention where the roll 10 corresponds to the roll 6 in FIG. 2, while the ring 11 corresponds to the tool 7 in FIG. 2. The ring 11 has an internal toothing 12 axially clearing the sides of the roll 10 and being engaged with a toothed drive 13 driven by a motor M. The roll 10 may be driven separately by a motor or by the ring 11 by means which will be described later, it being recalled that the peripheral speed of the roll 10 is somewhat greater than the internal peripheral speed of the ring 11.

When this difference in speed is optimum for achieving a completely symmetrical head, as viewed from the end, it may be expedient, depending upon inter alia the dimension of the head, that the extension of the shank, represented by the line L in FIG. 3, is disposed somewhat laterally of the centre C of the tool rings, ensuring that the surface of the finished head is exactly perpendicular to the shank. With the direction of rotation shown in FIG. 3, the shank must point to the left of the centre C, and forms thus an angle of the order of a couple of degrees with a radius for the ring 11.

The complete nail machine comprises some stations known per se, and they will therefore not be described in detail. They are indicated in FIG. 3, the operations of straightening, cutting and pointing, and insertion of the nail blank into the ring 11 being performed at the station 14. The nail blank is inserted radially, which is permitted by the inclined sides 15 in cavities 16 for receiving nails/nail blanks. For the sake of clarity, cavities 16 are only shown in the area around the roll 10, said area being called the working area in the following. However, corresponding cavities are present around the entire ring 11. The finished nails are removed at the station 17 from where they are taken to a location where they are packaged or stored. FIG. 4 shows a section taken along the line VI—VI in FIG. 3, and it will be seen that the ring includes two mutually inclined tool rings 11A and 11B secured to respective inner rings 18A and 18B of bearings that may be ball or roller bearings. The outer rings 19A and 19B, respectively, of said bearings are secured to associated supporting plates, 20A and 20B respectively. The plate 20A is shown in FIG. 3 and is rigidly attached to a base plate 21, while the plate 20B is pivotally secured to the base plate 21 so that the plates 20A and 20B with associated rings may be urged against each other by means of the bolt 22. The roll 10 is secured to a shaft 23 rotatably mounted to the plates 20A and 20B respectively by means of spherical bearings 23A and 23B.

FIG. 5 shows a section of one of the tool rings 11A or 11B shown in FIG. 4. The ring is secured to the associated inner ring by means of screws, and its internal periphery is shaped as a roll path 24. Said roll path 24 serves as supporting face for the roll 10 (see FIG. 4) having roll paths with surfaces 25A and 25B respectively for abutment on the respective roll paths on the rings 11A and 11B respectively. The diameter of the roll paths 25A and 25B is smaller than the diameter of the central part of the roll 10, whose surface 26 is adapted to co-operate with the nail blanks. The nail blanks are secured by means of split tools also called mould jaws, one half 27 of four mould jaws being shown in FIG. 5, the other, corresponding half of these tools being positioned in the other tool ring so as to be flush with the halves shown in FIG. 5. Each tool half 27 defines half of a mould cavity with a cavity 16 for receiving nail blanks, as shown at 9 in the figure, and with an opening 28. The cavity 16 comprises a passage 29 of a semi-channel cross section whose dimensions correspond to the nail shank dimension employed. It will therefore readily be understood that a nail blank may be retained against axial movement in a passage defined by a pair of tool halves within the working area previously mentioned, said area extending on both sides away from the roll 10, a distance which depends upon the divergent angle formed by the tool rings 11A and 11B, see FIG. 4. Thus, it will be understood that the nail blanks may be inserted radially at the station 14 (FIG. 3), the tool halves 27 being mutually spaced in pairs at this location, while the nail blanks will be effectively secured between mating tool halves 27 in said working area. Similarly, it will be understood that the finished nails may be removed at the station 17 shown in FIG. 3, where there is a maximum distance between the tool halves 27 permitting easy removal of the blank.

In FIG. 5 it will be seen that the upper side of the tool halves 27 are located somewhat (the distance "a" in FIG. 5) below the roll path 24, and as the roll paths 25A or 25B of the roll ride on the roll path 24 in constant touch therewith the difference in radius brings about a difference in the peripheral speed of the surface 26 of the roll 10 and the upper side of the tools 27 respectively, thus permitting in a simple manner the achievement of the said, desired difference in speed determined by the distance "a". The diameter of the surface 26 of the roll 10 is so determined that the surface 26 just clears the tools 27, and at the same time the force with which the roll 10 may be biassed towards the nail blanks, is taken up exclusively by the roll paths. FIG. 4 (and later FIG. 7) does not show this clearance because it is very small. In FIG. 5 the tool half 27 is shown as one piece, but as the part comprising the opening 28 and passage 29 must be cured, the tools are preferably divided as is shown in FIG. 6 illustrating another embodiment of the rings.

In FIG. 6 the lower part 16 of the tool is formed continuously with the ring 30, which has secured thereto, for example by means of screws, pieces 31 of hard metal shaped with the mould cavity shown in FIG. 5 with an associated passage in which the nail blank is secured within the working area. In FIG. 6 the ring 30 is also provided with a toothing 32 on the roll path adapted to be engaged with a corresponding toothing (not shown) on the roll paths of the roll. The toothing is necessary where the torque to be transmitted between the roll and the ring is of such a size that the said frictional force between the smooth roll paths is not sufficient.

The embodiment of the machine according to the invention which has been described above includes only two rings for receiving nail or screw shanks in a single radial plane. However, the production rate may be stepped up by placing three or more rings side by side, so that a single roll extending through all the rings may form heads on a plurality of shanks located in axial planes for the rings. It will still be possible for the shanks to be secured by inclining the rings with respect to one another, but in the event of a large number of rings it may be expedient to employ other means for securing the shanks in the working area, which will be explained below with reference to FIG. 7.

FIG. 7 shows three rings 33, 34, 35 which like in the embodiment described above are secured to respective inner rings of bearings which are not shown in the figure for the sake of clarity, it being easy for a skilled person to add such machine parts. The machine parts not shown also secure a roll 36 having two roll paths 37, 38 for co-operating with shanks 39, 40 secured in their respective split tools, 41, 42 and 43, 44 respectively. The roll paths 37, 38 are provided with an annular bead 45, 46 level with the shanks 39, 40, said bead clearing a cut-out 45A, 46A in the tools and forming a slot in the head of the shanks 39, 40 which may thus be screw shanks. The roll 36 is furthermore provided with roll paths 47, 48, 49 abutting on associated roll paths on the rings 33, 34, 35 as was explained in connection with FIG. 4, and it will be understood that the roll paths may either be formed as shown in FIG. 5 or as shown in FIG. 6. It is not necessary for the intermediate ring 34 to be driven by the roll, it being rotated by the associated tools partially surrounding the screw shanks in the working area which thus serve as carriers. Alternatively, all rings in the described embodiment may be provided with carrier studs (not shown) which are circumferentially spaced and extend axially through the rings for transferring torque between these.

FIG. 7 shows that the tool halves 41 and 44 extend through associated holes in the respective rings 33 and 35 and protrude from the outer plane sides of these. The projection on said tool halves is adapted to co-operate with respective means 50 and 51 respectively, which are of uniform construction, and therefore only the means 51 will be explained more fully in connection with FIG. 8. Said means are adapted to exert a powerful pressure on the tool halves 41 and 44 within the previously defined working area, whereby the shanks 39 and 40 as well as the other shanks present within the working area are retained against axial movement during the co-operation with the roll.

As mentioned, FIG. 8 shows one clamping means 51, seen from above in FIG. 7. The clamping means comprises two, preferably driven chain wheels 52, 53 around which a chain runs which comprises a plurality of rotatable rolls 54 interconnected by sectional plates 55, as is shown in FIG. 7, and located in parallel with the axis of rotation of the wheels 52 and 53. A guide block 56 is provided between the chain wheels 52 and 53, which is biassed by a predetermined force towards the chain, and for co-operation with the chain said guide block has a guide path 57 preferably inclined at the ends, said guide path defining the extent of the working area. Since the clamping means 50 is shaped in the same manner as the clamping means 51 it will be understood that within the working area there can be obtained a pressure against the tools sufficient for securing the shanks, while outside the working area they are so loose in the tools that they may be inserted into and removed from these.

The shanks may alternatively be retained against axial movement away from the roll by means of a crawler mechanism of the same type as the one shown in FIG. 8, by positioning such a mechanism in the working area at the end of the shanks which is opposite the head. In that case, the tools should be adapted only to control the shanks and to define the shape of the head.

FIG. 9 shows some expedient details of another embodiment of the machine according to the invention. FIG. 9 shows a section of the machine, said section corresponding to the one shown in FIG. 4 of the embodiment previously described. The outer rings 60, 61 of the two large bearings are, as described above, secured to the respective side members 62, 63 of the machine, for example by means of the screws (not shown). The inner rings 64, 65 of the bearings clear the side members 62, 63, and the inner ring 64 is provided with an internal toothing in engagement with a toothed drive 67 driven by a drive motor (not shown). The inner rings carry their respective halves 68 and 69 of a plurality of split tools which will be described in connection with FIGS. 10–12. A shaft 70 is rigidly connected to a roll 71 rotated by means of a gear wheel 72 which is likewise rigidly connected to the shaft 70 and which is engaged with the toothing 66. The pitch diameter of the gear wheel 72 is smaller than the diameter of the roll 71, making the peripheral speed of the roll 71 somewhat greater than the speed of the end of a nail blank 73 co-operating with the roll 71.

The embodiment shown in FIG. 9 is also provided with a guard plate 74 which is mounted substantially closely adjacent the internal periphery of the ring 64 and which may be attached by means of support legs to the side plate 62 as shown at 75. Thus, it will be seen that the entire power transmission of the machine is located behind the guard plate 74, preventing any foreign bodies from getting jammed between the toothings. But then the machine is also accessible without any danger from the other side through an opening 76 in the side plate 63 so that the machine may be inspected and so that the finished nails may be ejected by the ejection station 77 shown schematically.

The tool halves or mould jaws 68, 69 are shown on a larger scale in FIG. 10, where they are designated 68*a* and 69*a*. The mould jaws have between them a nail with a round head 78 formed by co-operation with the roll of which a section 71*a* is shown. In relation to the mould jaws previously described the mould jaws 68*a* and 69*a* are characteristic in that besides comprising a passage for securing the nail the mould cavity between the jaws define an opening with conical side faces directed towards the roll 71*a*. In other words the mould jaws 68*a* and 69*a* do not define the rim of the nail head; it is brought about by free forming partly at a level outside the mould jaws, permitting a greater clearance between the mould jaws and the roll. In connection with the guard plate 74 in FIG. 9 this feature ensures that no foreign bodies will get jammed in the machine.

The opening in the mould jaws 68*a*, 69*a*, defining the inclined under side of the head 78, does not have to be conical, but may assume other shapes which fit for example the under side of a nail with a square head. What is important is, as mentioned, that the rim of the nail head is made by free forming, which is feasible by correct adjustment of the various parameters of the machine, as for example the frictional coefficient between the roll 71*a* and the nail head. This parameter may be varied by providing the surface of the roll with pattern promoting the friction as is indicated at the top of the roll 71 in FIG. 9. Preferably, the mould jaws are so arranged that the position of the nail shank indicated by the line L in FIG. 3 may be obtained.

The free forming described above is also applicable for forming reduced nail heads, for example by means of the mould jaws 78, 79 shown in FIG. 11. The opening in the mould jaw 79 defines only the under side of the nail head 80 so that the curved rim of the nail head is provided by free forming. The straight rim of the nail head is defined by a plane face 82 which is provided on the mould jaw 78 and extends at least from the under rim of the nail head and a distance upwardly on the plane side face of the roll, of which a section 81 is shown. It is observed that the nail head will be turned 90° with respect to the location of the nail heads in the tools shown in FIGS. 5 and 6.

It has already been explained that a burr along the straight edge of the reduced nail head is not desirable. Such a burr might occur in the tools shown in FIG. 11 when they are worn, but is totally avoided by means of the tools shown in FIG. 12. The mould jaw 79*a* is formed in the same manner as the mould jaw 79, but the mould jaw 78*a* is recessed so that it just clears a flange 83 on the roll 81*a*. The annular, radial face 84 located between the surface of the roll 81*a* and the flange 80 is thus part of the forming tool, thereby obviating any risk of such burr being formed. It has been found that the deformation of the nail material in the forming of the head does not spread far down into the nail shank, and in practice there may thus be a small clearance between the flange 83 and the mould jaw 78*a* without any risk of a burr being formed at this location.

Conclusively, the machine according to the invention offers may advantages of which several have already been mentioned. Moreover, the machine consumes less power as no accelleration power is lost as is the case in known, commercially available machines due to the translatory movements. This circumstance results in a low level of noise, little wear and long life. The production rate may be increased considerably in relation to the prior art, it being stressed that owing to the internal rolling optimum working conditions may be obtained which permit not only a great production rate, but also narrow tolerances and minimize formation of burrs.

What we claim is:

1. A machine for providing a shank of substantially uniform cross-section, such as a nail, with an enlarged head at one end thereof, said machine comprising an annular tool having a central axis and also having an internal surface bounding a substantially cylindrical space, said tool being provided with means for receiving a plurality of shanks and for securing the shanks so that they extend substantially radially of said tool with each shank having its said one end protruding into said substantially cylindrical space, and the machine also comprising a roll having a central axis and mounted in said substantially cylindrical space with its central axis extending substantially parallel to the central axis of said tool, and means for rotating said tool in a predetermined direction about the central axis thereof and for bringing about relative rolling movement between the roll and the annular tool to effect rotation of the roll in the same direction as the tool to enable the roll to press on said one ends of said shanks successively to provide enlarged heads thereon.

2. A machine as claimed in claim 1, wherein said means for rotating the tool and for bringing about relative rolling movement comprise drive means for driving the annular tool to rotate and wherein the annular tool has a drive surface and the roll also has a drive surface which engages the drive surface of the tool so that the roll is caused to rotate with the annular tool the roll having a cylindrical surface for pressing on the shanks, which cylindrical surface is of larger diameter than the drive surface of the roll and clears the internal surface of the annular tool.

3. A machine as claimed in claim 1, wherein the annular tool defines a plurality of cavities for receiving the shanks respectively, each cavity being disposed so that the central axis of a shank fitted therein forms an acute angle with the radius of the tool extending to said one end of the shank received in said cavity.

4. A machine as claimed in claim 1, wherein the annular tool comprises at least two rings of like construction positioned side by side, each ring having a plurality of mold halves which cooperate with the mold halves of the other ring to define in pairs cavities for receiving respective shanks, and wherein the rings are mounted to rotate about their central axes respectively, the planes of the rings, extending perpendicular to the respective central axes, being mutually inclined at an acute angle and diverging from a working area where the roll presses upon the shanks, the line bisecting the acute angle included between the central axes of the rings constituting the central axis of the annular tool.

5. A machine as claimed in claim 4, wherein each mold half is formed by a mold jaw mounted replaceably in the side face of the respective ring that faces the other ring.

6. A machine as claimed in claim 5, wherein the mold jaws are replaceably mounted in the rings.

7. A machine as claimed in claim 5 or 6, wherein at least a portion of each mold jaw extends substantially axially with respect to the central axis of the ring in which it is mounted and through a recess in the ring so as to protrude beyond the side face of the ring that is further from the other ring, and the machine comprises stop means mounted on opposite sides of the annular tool at the working area for engaging the protruding portions of the jaws and urging them together thereby to retain the shanks against longitudinal movement.

8. A machine as claimed in claim 4, wherein the means for retaining the shanks against longitudinal movement comprise stop means for cooperating with the shanks at the working area, said stop means being mounted closely adjacent the outer periphery of the rings.

9. A machine as claimed in claim 4, wherein each mold cavity has a channel-shaped portion for receiving a portion of the shank and merging into an evenly increasing opening at the end facing the center of the annular tool.

10. A machine as claimed in claim 9, wherein one mold half of each pair of mold halves has a face directed towards the other mold half of the pair, said face forming an extension of the surface of said one mold half which bounds the channel-shaped cavity and extending towards the center of the annular tool beyond said other mold half, said roll having a plane side face abutting said face of said one mold half.

11. A machine as claimed in claim 9, wherein the roll has an annular flange extending from the roll surface which acts upon the shanks so as to define a radial face lying in the plane of that face of one of the mold halves which bounds the channel-shaped cavity, said one mold half being recessed so as to clear the outer periphery of said annular flange.

12. A machine as claimed in claim 9, 10 or 11, wherein one of said rings is formed at its interior with teeth and the roll is secured to a shaft which carries a wheel formed with teeth which are in meshing engagement with the teeth of said ring, the pitch diameter of the toothed wheel being smaller than the diameter of the roll surface which acts upon the shanks.

13. A machine as claimed in claim 12, wherein a guard plate is provided between the roll and the toothed wheel secured thereto, and the means for bringing about relative rolling movement between the roll and the annular tool comprise a drive motor having a toothed drive in meshing engagement with the teeth of said one ring, the drive motor being on the opposite side of the guard plate from the roll, the guard plate being located closely adjacent the internal periphery of said one ring, so as to prevent entry of foreign matter into the drive components of the machine.

14. A machine as claimed in claim 1, wherein said means for rotating the tool and for bringing about relative rolling movement comprise drive means for driving the annular tool to rotate and wherein the annular tool has an internal gear and the roll has an external gear which is in meshing engagement with the internal gear of the tool so that the roll is caused to rotate with the annular tool, the roll having a roll surface for pressing on the shanks, which roll surface is of larger diameter than the pitch circle of the external gear and clears the internal surface of the annular tool.

* * * * *